US008029384B2

(12) United States Patent
Chen et al.

(10) Patent No.: US 8,029,384 B2
(45) Date of Patent: Oct. 4, 2011

(54) GOLF CLUB HEAD

(75) Inventors: Chan-Tung Chen, Ksohsiung (TW); Wen-Ching Hou, Kaohsiung (TW); Chiang-Tai Lin, Kaohsiung (TW); Jiun-Hseng Chuang, Kaohsiung County (TW); Chun-Han Wu, Kaohsiung (TW)

(73) Assignee: Fusheng Precision Co., Ltd., Taipei (TW)

( * ) Notice: Subject to any disclaimer, the term of this patent is extended or adjusted under 35 U.S.C. 154(b) by 126 days.

(21) Appl. No.: 12/464,102

(22) Filed: May 12, 2009

(65) Prior Publication Data

US 2010/0292025 A1 Nov. 18, 2010

(51) Int. Cl.
*A63B 53/04* (2006.01)

(52) U.S. Cl. ..... 473/331

(58) Field of Classification Search ..... 473/324–350, 473/287–292

See application file for complete search history.

(56) References Cited

U.S. PATENT DOCUMENTS

| | | | | |
|---|---|---|---|---|
| 4,858,929 | A * | 8/1989 | Long | 473/290 |
| 6,733,400 | B2 * | 5/2004 | Sherwood | 473/290 |
| 7,014,568 | B2 * | 3/2006 | Pelz | 473/287 |
| 7,056,226 | B2 * | 6/2006 | Kennedy | 473/330 |
| 7,156,751 | B2 | 1/2007 | Wahl et al. | |
| 7,691,007 | B2 * | 4/2010 | Ban et al. | 473/330 |
| 7,758,449 | B2 * | 7/2010 | Gilbert et al. | 473/330 |
| 7,780,548 | B2 * | 8/2010 | Solheim | 473/330 |
| 7,798,917 | B2 * | 9/2010 | Nguyen et al. | 473/330 |
| 2009/0305812 | A1 * | 12/2009 | Nakamura | 473/331 |
| 2010/0056295 | A1 * | 3/2010 | Ban et al. | 473/331 |

* cited by examiner

*Primary Examiner* — Sebastiano Passaniti
(74) *Attorney, Agent, or Firm* — CKC & Partners Co., Ltd.

(57) ABSTRACT

A golf club head includes a striking face having a plurality of grooves formed therein. At least one groove includes a first curved side surface, a second curved side surface opposite to the first curved side surface, and a bottom surface connecting the first and the second curved side surfaces. As viewed in the longitudinal direction of the at least one groove, the first and the second curved surfaces respectively have first and second involute profiles. A distance measured between the first and the second curved surfaces continuously increases from the bottom surface to the striking face.

12 Claims, 6 Drawing Sheets

GOLF CLUB HEAD

BACKGROUND

1. Field of Invention

The present invention relates to a golf club head, and more particularly to a golf club head including at least one groove disposed on a striking face of the golf club head and having a specific profile.

2. Description of Related Art

During competitions, golfers generally select a particular golf club according to how far it is desired for a golf ball to travel after the golf ball is struck by the club. However, during competitions, the ball's travel distance is not only affected by the selected the golf club but also by what happens after the ball strikes the ground. After the ball strikes the ground, its movement is primarily affected by the amount of backspin imparted on the ball by the golf club. A ball having a greater amount of backspin after being struck will have less forward roll after it lands on the ground. In general, less forward roll provides precision landing of the golf ball on a golf green. Conversely, lack of sufficient backspin will create too much forward roll after landing on the ground, which can cause a golf ball to unmanageably roll either off of the green or in a direction away from a golf hole.

To gain backspin during striking, grooves are generally placed in and extended across the striking face of a golf club. The grooves can affect contact characteristic between the striking face and a golf ball during striking to control an amount of backspin of the ball after being struck. A variety of groove configurations have been proposed to increase the amount of backspin of a golf ball after being struck. For fairness of competition, the golf club heads used in the competition must meet the U.S. Golf Association ("USGA") rules of golf, e.g. rules regarding the width of grooves, the depth of grooves, or the distance between grooves.

Under the USGA rules, it is very difficult to fulfill the requirements of effective grooves that impart enough backspin to the struck ball. Grooves capable of providing a relatively large amount of backspin usually can't meet the USGA rules. In other words, the grooves allowed under the USGA rules usually provide a relatively small amount of backspin.

Accordingly, it is desired to have a novel golf club head that imparts increased backspin to the ball while meeting the USGA rules regarding the grooves in the striking face of the golf club head.

SUMMARY

It is an object of the present invention to provide a golf club head, which not only can easily meet the USGA rules regarding the grooves disposed in the striking face but also can impart enough backspin to the struck ball.

To achieve the above listed and other objects, the present invention provides a golf club head including a striking face having a plurality of grooves formed therein. At least one groove includes a first curved side surface, a second curved side surface opposite to the first curved side surface, and a bottom surface connecting the first and the second curved side surfaces. As viewed in the longitudinal direction of the at least one groove, the first and the second curved side surfaces respectively have first and second involute profiles. A distance measured between the first and the second curved side surfaces continuously increases from the bottom surface to the striking face.

One advantage of the present invention is to increase the backspin of a golf ball struck by a golfer in order to raise the scores and competitiveness of the golfer in competitions. Furthermore, another advantage of the present invention is that the grooves of the present invention can be designed to have a larger bottom width than conventional V-shaped or U-shaped grooves when the top width thereof is kept the same Therefore, it is relatively easy to machine the grooves of the present invention with less wear on the cutter.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion. In the accompanying figures.

DESCRIPTION OF THE PREFERRED EMBODIMENTS

Figure 1:
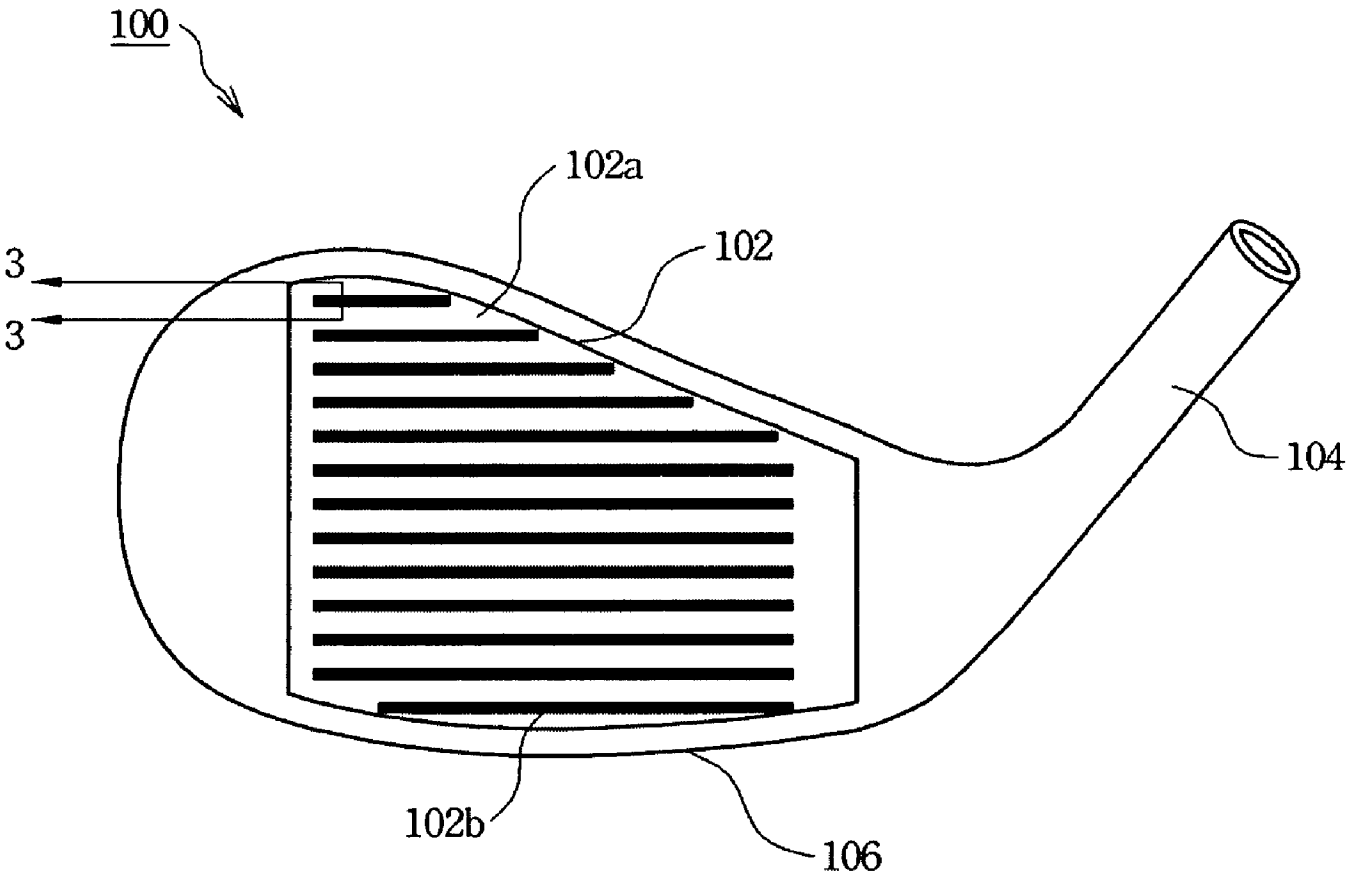
FIG. 1 is a front view of a golf club head according to one embodiment of the present invention.

While the present invention is susceptible of embodiment in various forms, there are presently preferred embodiments shown in the drawings and will hereinafter be described with the understanding that the present disclosure In is to be considered as an exemplification of the invention and is not intended to limit the invention to the specific embodiment illustrated.

FIG. 1 shows a golf club head 100 according to one embodiment of the present invention. The golf club head 100 generally includes two portions, i.e., a striking plate 102 and a main body 104. The striking plate 102 includes a striking face 102*a* having a plurality of grooves 102*b* formed therein, wherein the grooves 102*b* extend horizontally in a direction substantially parallel to the bottom 106 of the golf club head 100.

In the present invention, the main body 104 constitutes the remainder of the golf club head 100 except the striking plate 102. The main body 104 can be composed of metals such as carbon steel (e.g. carbon steel corresponding to JIS S20C or S25C), stainless steel (e.g. 17-4PH stainless steel), alloy steel, Fe—Mn—Al alloy, nickel based alloys, cast iron, super alloy steel, pure titanium, titanium alloy (e.g. Ti6Al4V or Cp-Ti), aluminum alloy, magnesium alloy, or copper alloy. The striking plate 102 and the main body 104 can be integrally formed together through casting, powder sintering, forging, machining, and the like. Alternatively, the golf club head 100 of the present invention may be manufactured by casting the main body 104 having a striking plate 102—fitting opening by a lost wax method, fitting the striking plate 102 in the opening, and welding the striking plate 102 to the main body 104. If a welding process is applied to the striking plate 102 and the main body 104, the welded golf club head 100 may be further subjected to grinding, polishing or age hardening. Furthermore, the striking plate 102 to be welded to the main body 104 can be manufactured through extrusion, casting, or forging.

Furthermore, for adjusting a golf club head's center-of-gravity, the golf In club head may further include a balance weight made of a material having a specific gravity higher than that of the golf club head's main body, e.g., tungsten alloy, W—Fe—Ni alloy, copper alloy or combinations thereof. The balance weight can be manufactured through casting, forging, powder metallurgy, and the like.

Figure 2:
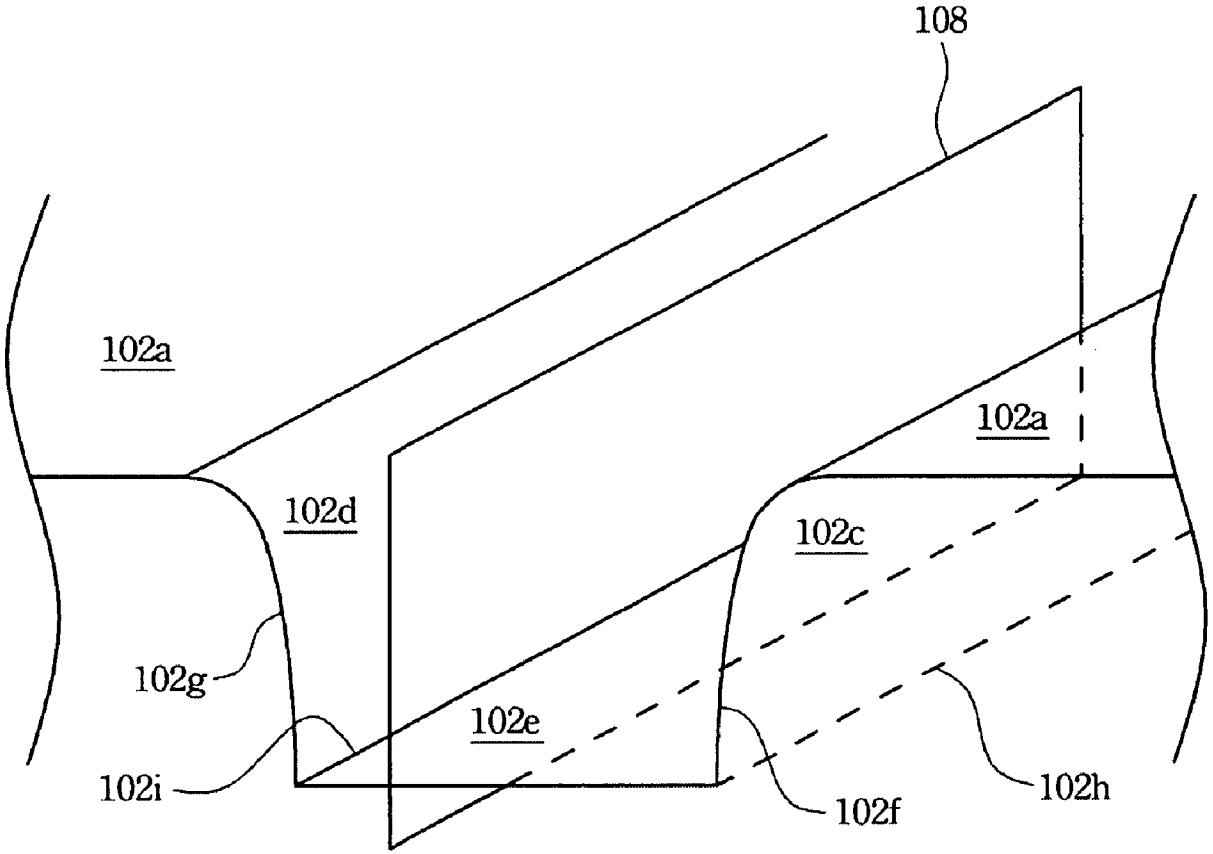
FIG. 2 is a 3-dimensional schematic diagram showing one groove of the golf club head of FIG. 1.
Figure 3:
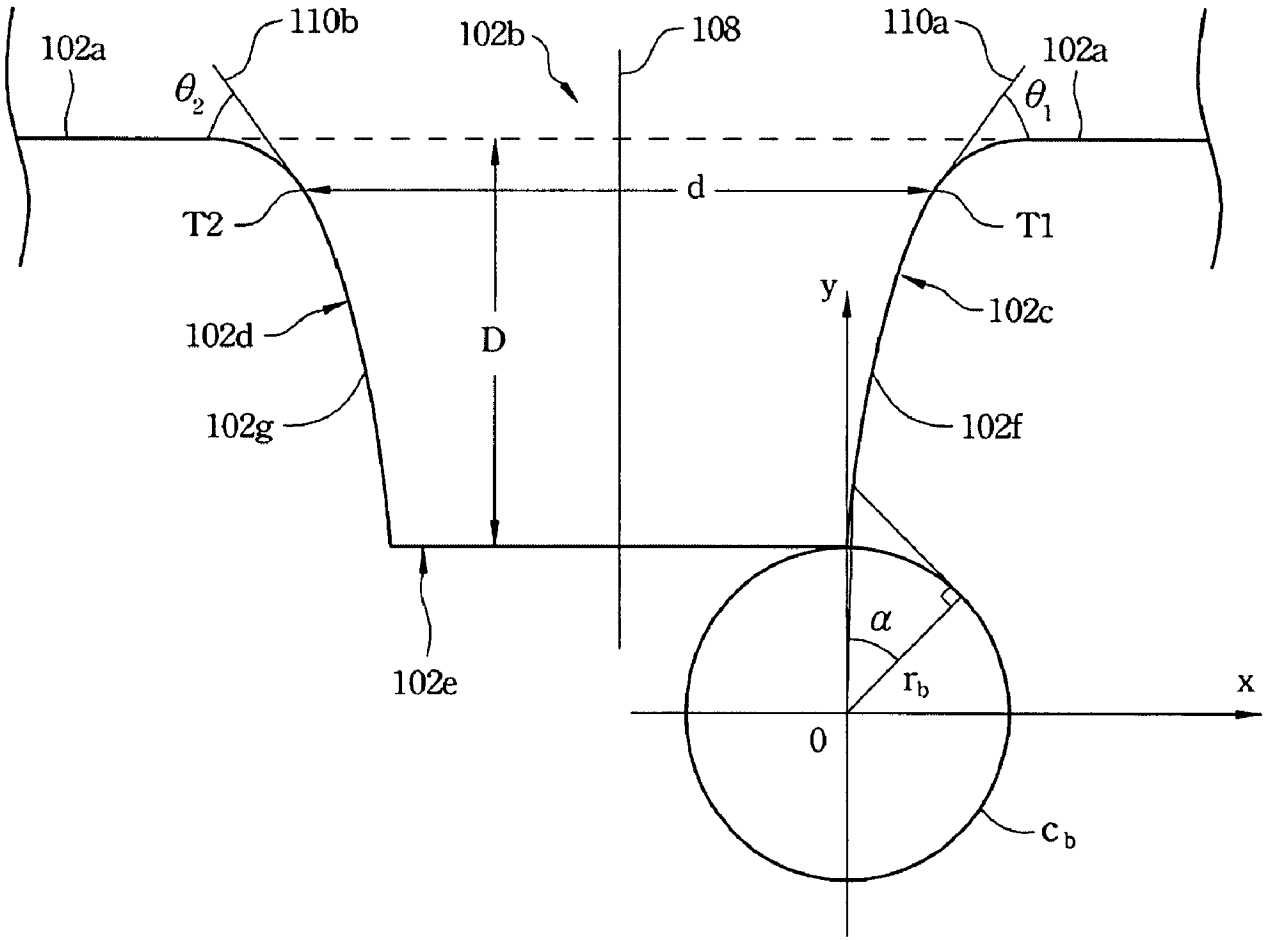
FIG. 3 is a sectional view of the groove of FIG. 2 taken along line 3-3 of FIG. 1.

Please refer to FIG. 2 and FIG. 3. FIG. 2 is a 3-dimensional schematic diagram showing one groove 102*b* of the golf club head of FIG. 1. FIG. 3 is a sectional view of the groove 102*b* taken along line 3-3 of FIG. 1. The groove 102*b* includes a curved side surface 102*c*, a curved side surface 102*d*, and a bottom surface 102*e*. The curved side surface 102*c* and the curved side surface 102*c* are respectively disposed at the opposite edges of the bottom surface 102*e*, that is to say, the bottom surface 102*e* connects the curved side surfaces 102*c* and 102*d*. As shown in FIG. 2, the curved side surfaces 102*c* and 102*d* respectively have an involute profile 102*f* and an involute profile 102*g* as viewed in the longitudinal direction of the groove 102*b*, and a distance measured between the involute profiles 102*f* and 102*g* continuously increases from the bottom surface 102*e* to the striking face 102*a*.

Referring to FIG. 2 and FIG. 3, the involute profiles 102*f* and 102*g* are respectively generated from a base circle $C_b$ and another base circle (not shown), wherein the curved side surfaces 102*c* and 102*d* are respectively connected to the bottom surface 102*e* along intersection lines 102*h* and 102*i* (see FIG. 2). The intersection line 102*h* is tangent to the base circle $C_b$, and the intersection line 102*i* is tangent to the another base circle.

Hereinafter, the involute profile 102*f* is used as an example to explain how the involute profiles 102*f* and 102*g* are generated. Referring to FIG. 3, the involute profile 102*f* may be defined by the equations below:

$$x = \frac{r_b}{\cos\alpha} \cdot \sin(\tan\alpha - \alpha)$$

$$y = \frac{r_b}{\cos\alpha} \cdot \cos(\tan\alpha - \alpha)$$

wherein the origin of the coordinates is at the center O of the base circle $C_b$, $r_b$ represents the radius of the base circle $C_b$, and $\alpha$ represents the pressure angle between the involute profile 102*f* and the base circle $C_b$. The desired involute profiles 102*f* is generated by adjusting the location of the center O and the radius $r_b$ of the base circle $C_b$. Since the involute profiles 102*g* and 102*f* extend in generally opposite directions, the involute profile 102*g* is generated under a coordinate system with the axis X opposite in direction to the axis X of the involute profile 102*f*'s coordinate system. When the curved side surfaces 102*c* and 102*d* of the grooves 102*b* are designed to have an involute profile, the contact points between a golf ball and the grooves 102*b* will remain on the pitch circle (not shown) during the rotation of the ball being struck thereby reducing sliding therebetween, smoothing the rotation and increasing the ball's backspin. Furthermore, there are USGA rules related to the longitudinal profile of a transition region between the curved side surface 102*c* and the striking face 102*a*, and they are described as below: First, draw a smaller circle having a radius of 0.010 tangent to the curved side surface 102*c* and the striking face 102*a*, and a larger circle concentric with the smaller circle and having a radius of 0.011 inch. If the longitudinal profile of the transition region between the curved side surface 102*c* and the striking face 102*a* protrudes outwardly away from the larger circle, the groove 102*b* does not meet the USGA rule. Since the involute profile 102*f* of the groove 102*b* and the concentric circles curve in substantially the same direction, it is relatively easy for the groove 102*b* of the present invention to meet the USGA rule.

In this embodiment, the radius $r_b$ of the base circle $C_b$ used to generate the involute profile 102*f* is the same as the radius of the base circle (not shown) used to generate the involute profile 102*g*. As shown in FIG. 2 and FIG. 3, for meeting the USGA rules, the groove 102*b* is substantially symmetrical about a plane 108 that bisects the bottom surface 102*e* as viewed in the longitudinal direction of the groove 102*b*. However, this is not intended to limit the invention to the specific embodiment illustrated herein. In other embodiments, the radius $r_b$ of the base circle $C_b$ used to generate the involute profile 102*f* can be different from the radius of the base circle (not shown) used to generate the involute profile 102*g*, or the groove 102*b* can be unsymmetrical about a plane 108 that bisects the bottom surface 102*e*.

Referring to FIG. 3 again, the groove 102*b* of the golf club head 100 has a USGA groove width d. The groove width d is measured along a line extending between a pair of tangent points T1 and T2 where a pair of oppositely spaced tangent lines 110*a* and 110*b* are respectively tangent to the curved side surfaces 102*c* and 102*d*, wherein the angle $\theta_1$ included between tangent line 110*a* and the striking face 102*a* is 30 degrees and the angle $\theta_2$ included between tangent line 110*b* and the striking face 102*a* is also 30 degrees. In certain embodiments, the USGA groove width d is less than or equal to 0.037 inch (0.9398 mm).

Referring to FIG. 3, the groove 102*b* of the golf club head 100 has a USGA groove depth D measured as the perpendicular distance from an extension line (see dash line in FIG. 3) of the striking face 102*a* down to the lowest point of the bottom surface 102*e* as viewed in the longitudinal direction of the groove 102*b*. In certain embodiments, the USGA groove depth D is less than or equal to 0.020 inch (0.508 mm).

Figure 5A:
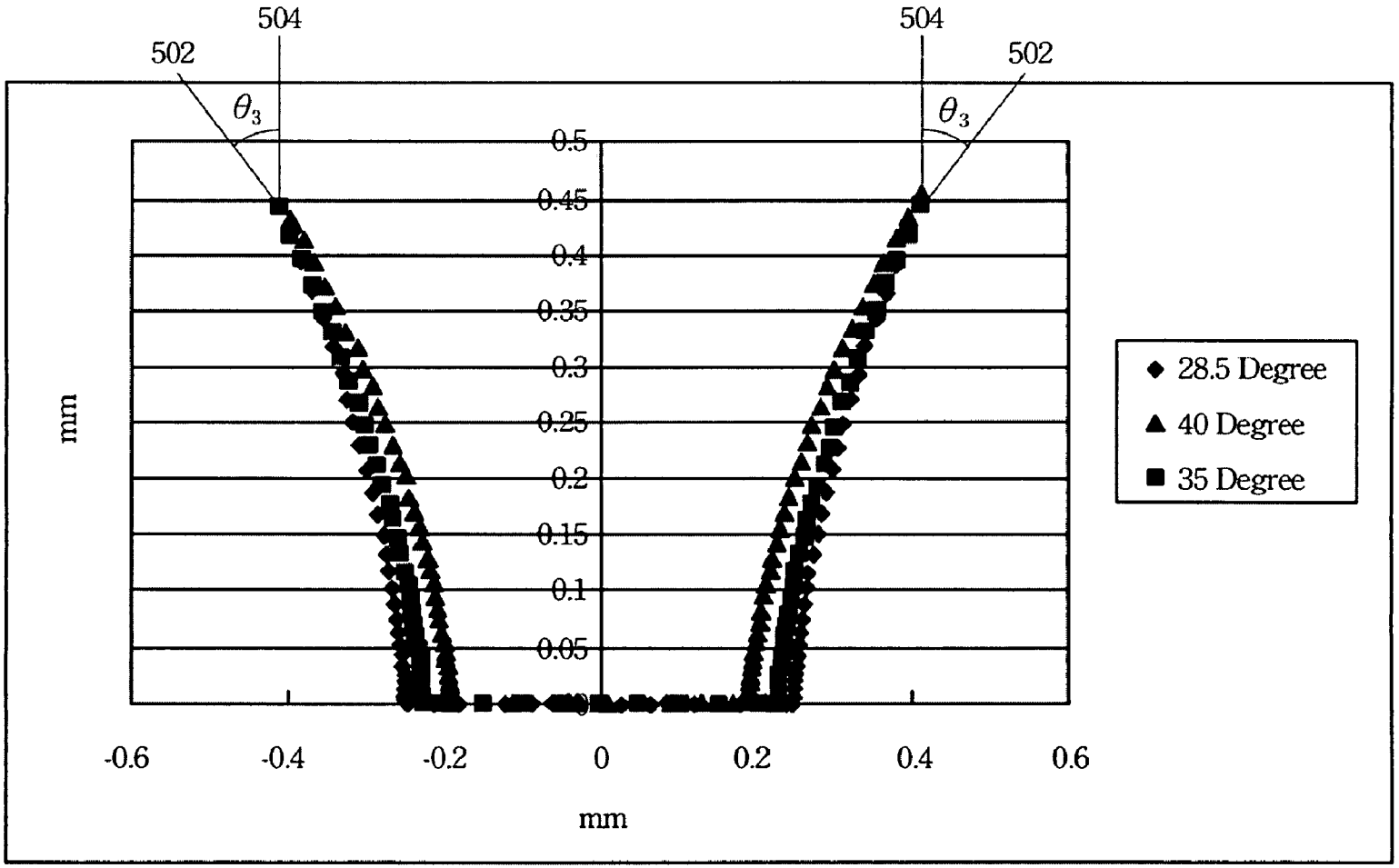
FIG. 5A is a schematic diagram showing three different groove outlines of the present invention.

Referring to FIG. 5A, a line 502 drawn tangent to the involute profile at a top end-point thereof is inclined at an angle $\theta_3$ with respect to a normal line 504 perpendicular to the bottom surface of the groove, wherein the tangent point between the line 502 and the involute profile is located on the striking face 102*a* of the striking plate 102. In certain embodiments, the angle $\theta_3$ is less than or equal to 40 degrees and more than or equal to 28.5 degrees.

As shown in FIG. 2 and FIG. 3, in this embodiment, the bottom surface 102*e* is substantially planar, but in other embodiments, the bottom surface 102*e* also can be curved.

Figure 4:
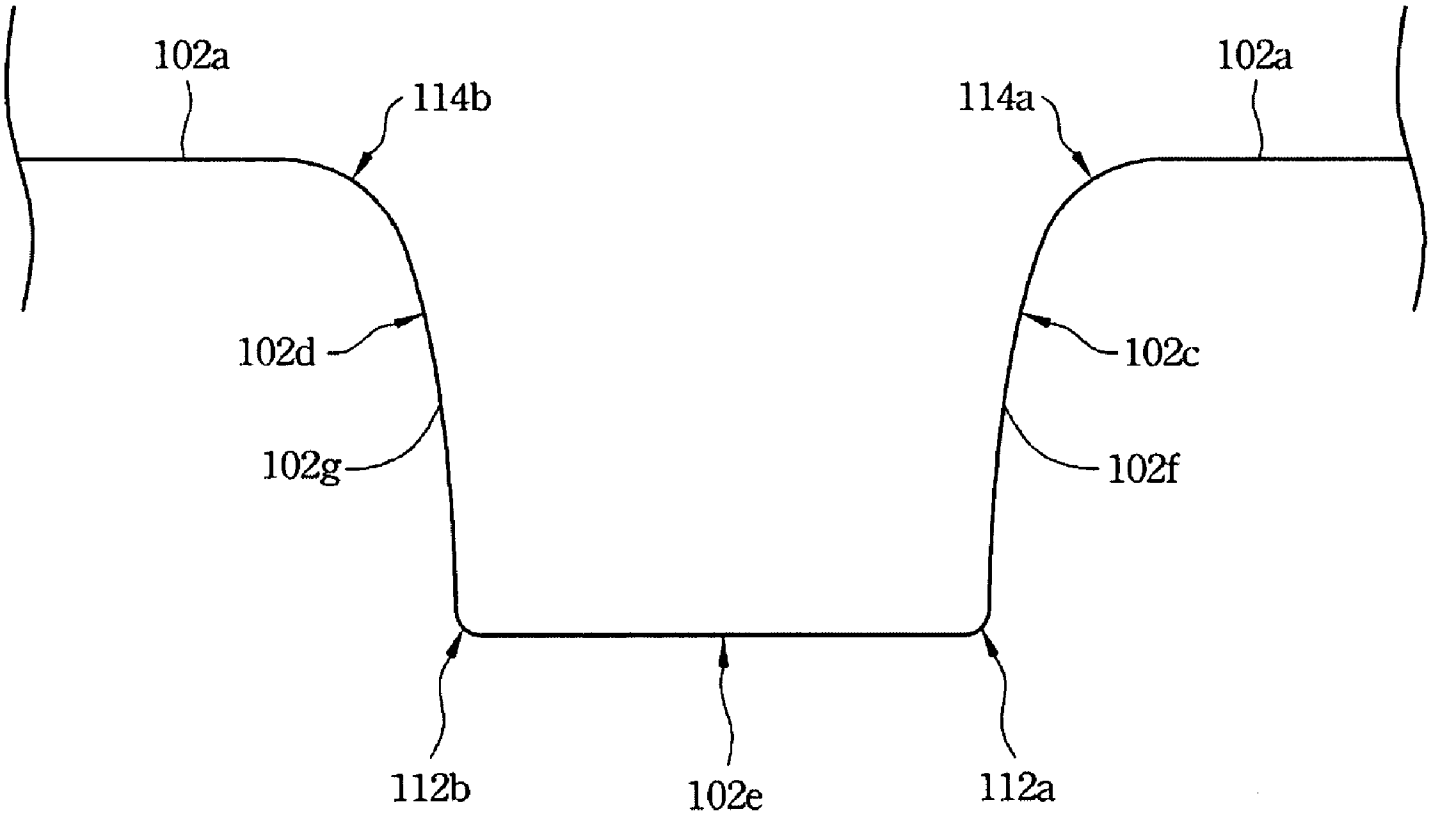
FIG. 4 is a sectional view of one groove according to another embodiment of the present invention.

Please refer to FIG. 4, which is a sectional view of one groove according to another embodiment of the present invention. The groove of FIG. 4 is similar to the groove 102*b* as shown in FIG. 3, and includes the curved side surface 102*c*, the curved side surface 102*d*, and the bottom surface 102*e*. As shown in FIG. 4, the curved side surfaces 102*c* and 102*d* also respectively have an involute profile 102*f* and an involute profile 102*g* as viewed in the longitudinal direction of the groove. The difference between the groove of FIG. 4 and the groove 102*e* of FIG. 3 is that the groove of FIG. 4 further includes lower juncture regions 112*a*, 112*b* and upper juncture regions 114*a*, 114*b*. The lower juncture region 112*a* is disposed between the bottom surface 102*e* and the curved side surface 102*c*. The lower juncture region 112*b* is disposed between the bottom surface 102*e* and the curved side surface 102*d*. In this embodiment, both the lower juncture region 112*a* and 112*b* are curved, and the profiles of the lower juncture region 112*a* and 112*b* are respectively different from the involute profile 102*f* and the involute profile 102*g*. The upper juncture region 114*a* is disposed between the striking face 102*a* and the curved side surface 102*c*, and the upper juncture region 114*b* is disposed between the striking face 102*a* and the curved side surface 102*d*. In this embodiment, both the upper juncture region 114*a* and 114*b* are curved, and the profiles of the surfaces of the upper juncture region 114*a* and 114*b* are respectively different from the involute profile 102*f* and the involute profile 102*g*. To sum up, the equations used to generate the profiles of the lower juncture region 112*a* and the upper juncture region 114*a* of the groove are different from the equation used to generate the involute profile 102*f*, and the equations used to generate the profiles of the lower juncture region 112*b* and the upper juncture region 114*b* of the groove are different from the equation used to generate the involute profile 102*g*. Moreover, although the groove of this embodiment includes all of the juncture regions 112*a*, 112*b*, 114*a* and 114*b*, the groove of other embodiments may include only some of the aforementioned juncture regions.

Embodiment

Manufacturing Golf Club Head Including Striking Plate Having Grooves with Involute Profile First, the main body and the striking plate of a golf club head are cast, wherein the main body includes a toe portion, a sole portion, a top portion and a heel portion. Hereafter, a plurality of grooves are manufactured on the striking face of the striking plate by machining tools such that the cross section shape of each groove is identical with that shown in FIG. 5A. Alternatively, the grooves also can be manufactured by casting. In FIG. 5A, the angles $\theta_3$ of different golf club heads are respectively 28.5 degrees, 35 degrees, and 40 degrees. The lines 502 are respectively drawn tangent to the involute profiles of the golf club heads' striking plates at a top end-point thereof, wherein the top end-point is located on the striking face of a striking plate, and the bottom surface of each golf club head's grooves has a normal line 504 perpendicular thereto. $\theta_3$ represents the angle included between the line 502 and the normal line 504 wherein the normal line 504 is shifted to the tangent point between the line 502 and the corresponding involute profile. In FIG. 5A, the grooves of each golf club head are bilaterally symmetrical, that is to say, two opposite involute profiles are symmetrically located at two edges of one groove.

Figure 5B:
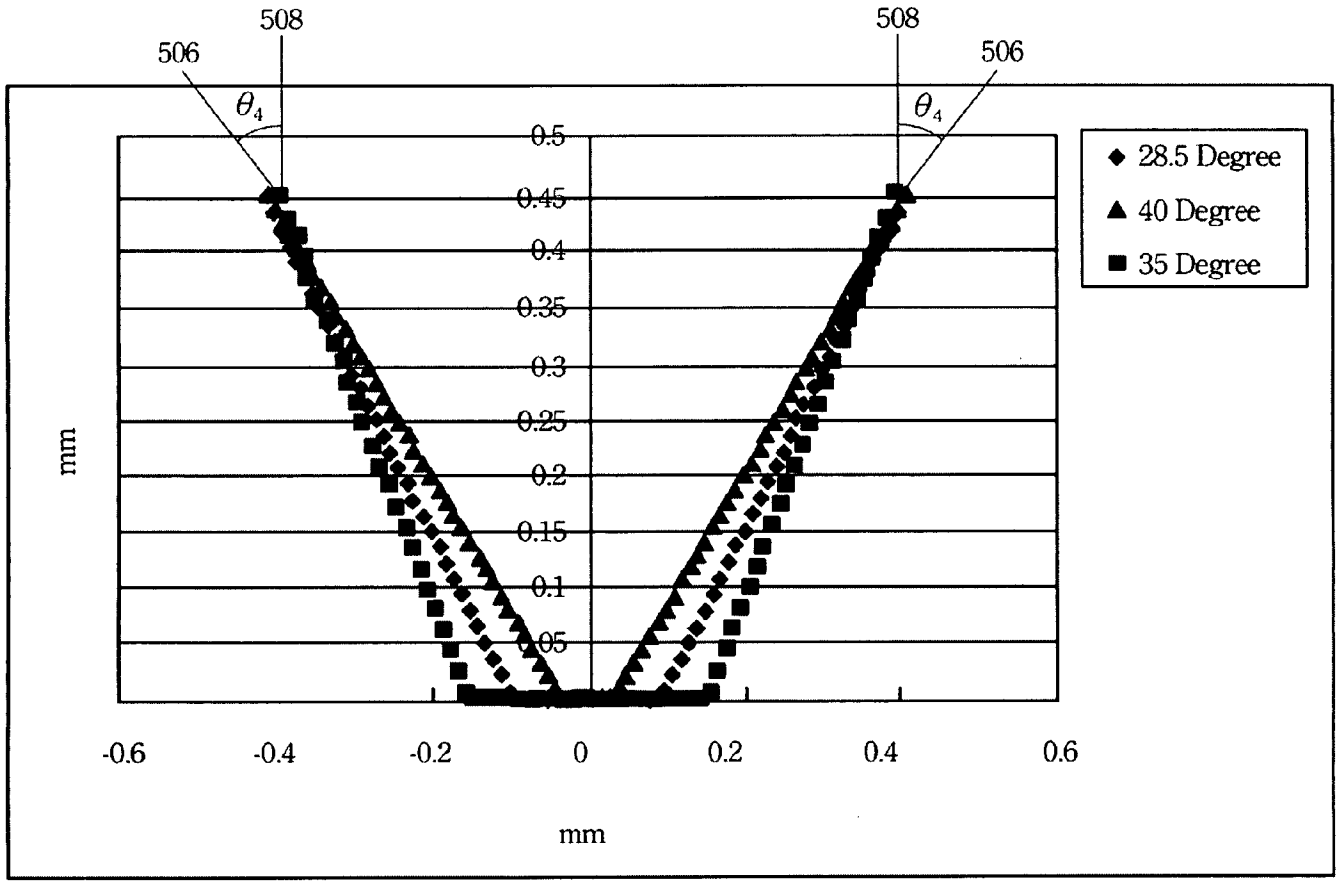
FIG. 5B (PRIOR ART)
FIG. 5B is a schematic diagram showing three conventional groove outlines.

Moreover, golf club heads having conventional grooves are manufactured such that the cross section shape of each groove is identical with that shown in FIG. 5B, and the angles $\theta_4$ of different golf club heads are respectively 28.5 degrees, 35 degrees, and 40 degrees, wherein the angle $\theta_4$ is an angle included between a line 506 and a normal line 508. The definitions of the line 506 and the normal line 508 are respectively similar to that of the line 502 and the normal line 504 above, and it will not be described in detail. In FIG. 5B, the grooves of each golf club heads are also bilaterally symmetrical.

The cross-sectional areas of the aforementioned grooves provided in the golf club heads having involute profiles of the present invention or in the conventional golf club heads are listed in Table 1 below. All of the golf club heads have the same distance measured between two top end-points of the grooves; that is to say, all of the golf club heads have the same groove width. From the data listed in Table 1, the grooves including involute profiles according to the present invention have a relatively large cross section area. Since the involute profiles are curved, the bottom width of the grooves of the present invention is larger than that of the conventional grooves. Therefore, it is relatively easy to machine the grooves having the involute profiles of the present invention with less wear on the cutter.

TABLE 1

| | $\theta_3 = 28.5°$ degrees | $\theta_4 = 28.5$ degrees | $\theta_3 = 35$ degrees | $\theta_4 = 35$ degrees | $\theta_3 = 40$ degrees | $\theta_4 = 40$ degrees |
|---|---|---|---|---|---|---|
| Cross-sectional areas of grooves ($mm^2$) | 0.264414 | 0.245506 | 0.263248 | 0.227172 | 0.247685 | 0.199061 |

The backspins of golf balls obtained from a striking test are listed in Table 2 below, and the backspin is measured in RPM (Revolution Per Minute). The golf balls are struck by the aforementioned golf club heads at a swing speed of 30 m/sec, and the loft angles of the golf club heads are in the range from 50 degrees to 60 degrees.

Table 3 shows a comparison result of the backspin of the golf balls obtained from the striking test using the golf club heads having conventional grooves listed in Table 2. Table 4 shows a comparison result of the backspin of the golf balls obtained from the striking test using the golf club heads having grooves with involute profile listed in Table 2.

TABLE 2

| Swing speed (30 m/sec) | Backspin under wet environment (RPM) | Loft angle 50 degrees | 52 degrees | 54 degrees | 56 degrees | 58 degrees | 60 degrees |
|---|---|---|---|---|---|---|---|
| 28.5 degrees | Conventional Groove | 1333 | 1233 | 1148 | 1054 | 960 | 869 |
| | Groove of Present invention | 1490 | 1403 | 1304 | 1213 | 1125 | 1030 |
| 35 degrees | Conventional Groove | 1215 | 1126 | 1033 | 938 | 850 | 751 |
| | Groove of Present invention | 1471 | 1375 | 1277 | 1191 | 1093 | 1002 |
| 40 degrees | Conventional Groove | 1071 | 979 | 886 | 794 | 702 | 609 |
| | Groove of Present invention | 1393 | 1300 | 1206 | 1118 | 1024 | 927 |

TABLE 3

| Backspin under wet environment (RPM) | | Loft angle 50 degrees | 52 degrees | 54 degrees | 56 degrees | 58 degrees | 60 degrees | RPM decrease from 50 degrees to 60 degrees (%) |
|---|---|---|---|---|---|---|---|---|
| Angle $\theta_4$ | 28.5 degrees | 1333 | 1233 | 1148 | 1054 | 960 | 869 | −34.8 |
| | 35 degrees | 1215 | 1126 | 1033 | 938 | 850 | 751 | −38.2 |
| | 40 degrees | 1071 | 979 | 886 | 794 | 702 | 609 | −43.1 |
| RPM decrease from 28.5 degrees to 40 degrees (%) | | −19.7 | −20.6 | −22.8 | −24.7 | −26.9 | −30.0 | |

TABLE 4

| Backspin under wet environment (RPM) | | Loft angle 50 degrees | 52 degrees | 54 degrees | 56 degrees | 58 degrees | 60 degrees | RPM decrease from 50 degrees to 60 degrees (%) |
|---|---|---|---|---|---|---|---|---|
| Angle $\theta_3$ | 28.5 degrees | 1490 | 1403 | 1304 | 1213 | 1125 | 1030 | −30.9 |
| | 35 degrees | 1471 | 1375 | 1277 | 1191 | 1093 | 1002 | −31.9 |
| | 40 degrees | 1393 | 1300 | 1206 | 1118 | 1024 | 927 | −33.5 |
| RPM decrease from 28.5 degrees to 40 degrees (%) | | −6.5 | −7.3 | −7.5 | −7.8 | −9.0 | −10.0 | |

The data listed in Table 3 and Table 4 show that, when the loft angle is kept constant, the backspin of the balls being struck decreases with the increase of the angles $\theta_3$ and $\theta_4$. Alternatively, when the angle $\theta_3$ or $\theta_4$ is kept constant, the backspin of the balls being struck decreases with the increase of the loft angle.

According to the data listed in Table 3, when the balls are struck by the golf club heads having conventional grooves and a loft angle of 50 degrees, the backspin of the balls being struck decrease by 19.7% when the angle $\theta_4$ of the grooves is changed from 28.5 degrees to 40 degrees. When the loft angle is 60 degrees, the backspin's decrease reaches up to 30.0%.

In contrast, the data listed in Table 4 show that, when the balls are struck by the golf club heads of the present invention having a loft angle of 50 degrees, the backspin of the balls being struck decrease by 6.5% when the angle $\theta_3$ of the grooves is changed from 28.5 degrees to 40 degrees. When the loft angle is 60 degrees, the backspin's decrease reaches up to 10.0%.

To sum up, the backspin's decrease can be significantly reduced to 10% at most by using the grooves of the present invention when the angle $\theta_3$ or $\theta_4$ of the grooves is changed from 28.5 degrees to 40 degrees. In contrast, the backspin's decrease can reach up to 30.0% when the conventional grooves are used. The backspin is increased by 52.2% from 609 RPM to 927 RPM when the grooves which imparts the smallest backspin ($\theta_3$ or $\theta_4$=40 degrees) are used for comparison. Accordingly, the golf club heads of the present invention can impart enough backspin to the struck ball. In addition, due to the curve feature of the involute profiles of the present invention, it is advantageous for the golf club heads of the present invention to meet the USGA rules regarding the grooves.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A golf club head including a striking face having a plurality of grooves formed therein, wherein at least one groove comprises:

a first curved side surface;

a second curved side surface opposite to said first curved side surface; and a bottom surface connecting said first and second curved side surfaces;

wherein said first and second curved side surfaces respectively have first and second involute profiles as viewed in the longitudinal direction of said at least one groove;

wherein the first and second involute profiles extend in generally opposite directions, and are respectively defined by the equations below:

$$x = \frac{r_b}{\cos\alpha} \cdot \sin(\tan\alpha - \alpha)$$

$$y = \frac{r_b}{\cos\alpha} \cdot \cos(\tan\alpha - \alpha)$$

wherein the origin of the coordinates is at the center of a predetermined base circle, and $r_b$ represents the radius of the predetermined base circle, and $\alpha$ represents the pressure angle between the first involute profile and the predetermined base circle or between the second involute profile and the predermined base circle;

wherein a distance measured between said first and said second curved side surfaces continuously increases from said bottom surface to said striking face.

2. The golf club head of claim 1, wherein said first involute profile is generated from a first base circle;

wherein said first curved side surface meets said bottom surface along a first intersection line tangent to said first base circle.

3. The golf club head of claim 1, wherein said second involute profile is generated from a second base circle;

wherein said second curved side surface meets said bottom surface along a second intersection line tangent to said second base circle.

4. The golf club head of claim , wherein said first and second involute profiles are respectively generated from a first base circle and a second base circle;

wherein the radius of said first base circle is the same as the radius of said second base circle.

5. The golf club head of claim 1, wherein said at least one groove is substantially symmetrical about a plane that bisects said bottom surface as viewed in the longitudinal direction of said at least one groove.

6. The golf club head of claim 5,wherein said at least one groove has a USGA groove width measured along a line extending between a pair of tangent points where a pair of oppositely spaced tangent lines, inclined at a 30-degrees angle to said striking face, are respectively tangent to said first and second curved side surfaces, and wherein said USGA groove width is less than or equal to 0.037 inch.

7. The golf club head of claim 5, wherein said at least one groove has a USGA groove depth by measuring a perpendicular distance from an extension line of said striking face down to the lowest point of said bottom surface as viewed in the longitudinal direction of said at least one groove, and wherein said USGA groove depth is less than or equal to 0.020 inch.

8. The golf club head of claim 5, wherein said at least one groove has a angle between a line and a normal line of said bottom surface;

wherein said line is tangent to said first or said second involute profile at a top end-point thereof, and said normal line is perpendicular to said bottom surface;

wherein said angle is less than or equal to 40 degrees and more than or equal to 28.5 degrees.

9. The golf club head of claim 1, wherein said bottom surface is substantially planar.

10. The golf club head of claim 1, wherein said bottom surface is curved.

11. The golf club head of claim 1, further comprising a lower juncture region disposed between said bottom surface and said first curved side surface, wherein the profile of said lower juncture region is different from said first involute profile as viewed in the longitudinal direction of said at least one groove.

12. The golf club head of claim 1, further comprising an upper ,juncture region disposed between said striking face and said first curved side surface, wherein the profile of said upper juncture region is different from said first involute profile as viewed in the longitudinal direction of said at least one groove.

* * * * *